United States Patent [19]

Pagel et al.

[11] 4,358,865

[45] Nov. 16, 1982

[54] DISPOSABLE SHEET SYSTEM FOR PATIENT STRETCHER

[75] Inventors: Kenneth L. Pagel, Manitowoc; Lester A. Mueller, Kewaunee, both of Wis.; Gary E. Nei, Stone Mountain, Ga.

[73] Assignee: American Hospital Supply Corporation, Evanston, Ill.

[21] Appl. No.: 88,892

[22] Filed: Oct. 29, 1979

[51] Int. Cl.[3] ..... A47G 9/02; A61G 7/00

[52] U.S. Cl. ..... 5/81 B; 5/487; 5/488; 428/43; 428/294; 428/910

[58] Field of Search ..... 312/37, 38, 39; 298/DIG. 5, 300; 5/86, 81 R, 81 B, 487, 488; 206/403, 408, 409; 220/224; 428/43, 910, 294

[56] References Cited

U.S. PATENT DOCUMENTS

| | | | |
|---|---|---|---|
| 1,507,949 | 9/1929 | Angier . | |
| 1,877,610 | 9/1932 | Steiner | 5/488 |
| 2,222,956 | 11/1940 | Seaton | 154/50 |
| 2,339,828 | 10/1967 | Worth . | |
| 2,841,801 | 7/1958 | Crown et al. | 5/488 |
| 3,315,676 | 4/1967 | Cooper | 428/43 |
| 3,344,444 | 2/1972 | McNeal | 5/88 |
| 3,430,905 | 3/1969 | Pepe | 248/300 |
| 3,466,679 | 9/1969 | Hess | 5/488 |
| 3,641,600 | 3/1972 | Oats | 5/488 |
| 3,646,624 | 3/1972 | Zipf . | |
| 3,956,782 | 5/1976 | Morrison | 5/465 |
| 4,025,973 | 5/1977 | Walbrecht | 5/488 |
| 4,034,926 | 7/1977 | Wegner | 206/409 |

*Primary Examiner*—Alexander Grosz

*Attorney, Agent, or Firm*—Larry Barger; Donald L. Barbeau

[57] ABSTRACT

A stretcher for patient support which has a roll of disposable sheeting beneath an end portion of the stretcher. Individual sheets are manually separated from the roll at transverse weakened sections in the sheeting material that are longitudinally separated by a distance greater than the length of a mattress pad plus twice its thickness. In one embodiment, a roll of disposable sheeting is encased within a housing that has a pivotally mounted openable section.

6 Claims, 12 Drawing Figures

DISPOSABLE SHEET SYSTEM FOR PATIENT STRETCHER

BACKGROUND OF THE INVENTION

There have been many attempts to sheet a bed or stretcher from a roll of sheeting material secured to the bed or stretcher. Many of these proposed the use of a dispensing roll at one end of the stretcher and a take-up roll at an opposite end of the stretcher. Such a system is not desirable because it stores the contaminated sheet on the take-up roll where is could possibly cross-contaminate patients using the same stretcher even though a new section of sheeting were advanced between the two rolls.

It has also been proposed to use a single dispensing roll and sever the sheeting and to discard it immediately after use. Various severing mechanisms have been proposed, such as knife-like structures at the end of the stretcher. Such knife cutters require continual maintenance to insure their sharpness and they can frequently malfunction. There is also the problem of having to measure each length before cutting it. Some examples of patents on roller dispensing sheet systems for stretchers or beds are U.S. Pat. Nos. 2,339,828; 2,466,679; and 3,641,600. One patent, U.S. Pat. No. 3,956,782, describes a sheet with sealed corners forming a "fitted" sheet of a precise length and width and a series of such sheet joined together by a series of perforations. The perforations were spaced apart a distance essentially equivalent to the mattress length. Such a fitted sheet was not suitable to take on varying lengths and widths of mattresses, such as might occur in stretchers of different manufacturers, models, styles, etc. The mattresses could also vary in thickness from approximately 2 inches to 8 inches.

SUMMARY OF THE INVENTION

The present invention overcomes the problems of the previous roller sheet dispensers. It provides a roll of disposable sheeting that has a series of transverse weakened sections that are longitudinally spaced a distance substantially greater than the mattress length plus twice its thickness. Thus, a single sheeting roll can fit numerous widths, lengths, and thicknesses of mattresses that might be used in various styles and models of stretchers and beds within a hospital. Because there are no transverse weakened sections within the body of the sheet, it cannot be pulled apart to give an unusable short sheet. Such short sheet might happen in a roll of material that had a series of intermediate square panels connected by perforations, such as in paper towels or toilet tissue.

In one embodiment, the roll of disposable sheeting is mounted to the stretcher with J-hook structure and in an another embodiment, a housing with a pivoted openable section is secured to the stretcher and encases the roll of sheeting.

THE DRAWINGS

DETAILED DESCRIPTION

Figure 1:
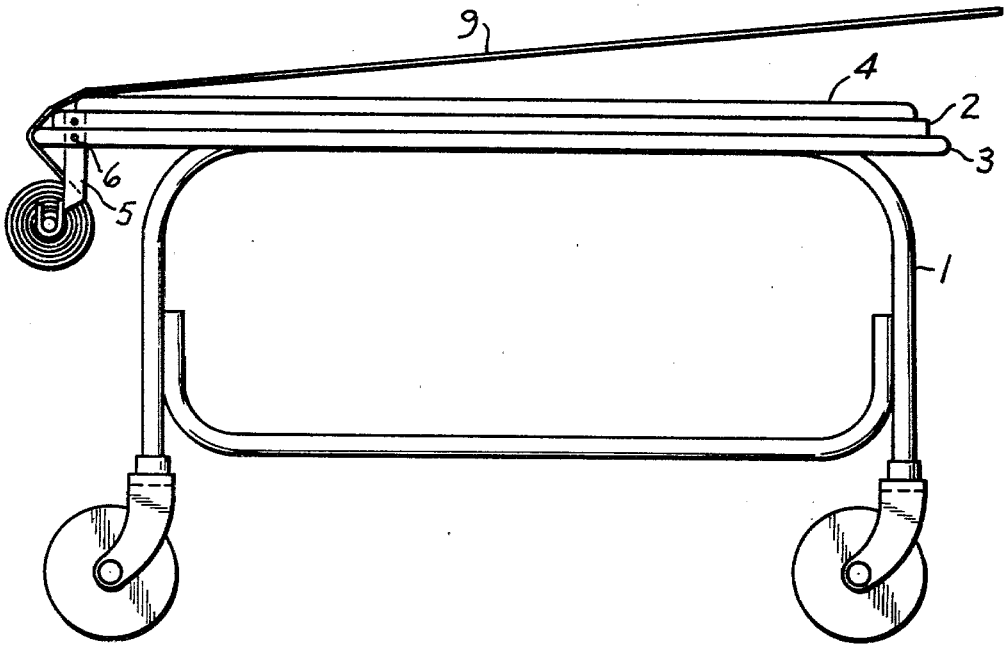
FIG. 1 is a side elevational view of a mobile stretcher with a first embodiment of the disposable sheet system installed.

Referring to the drawings, the stretcher is shown including a conventional wheeled substructure 1 supporting a stretcher top 2 which can have a pipe railing 3. Supported on top 2 is a resilient mattress pad 4. In a first embodiment, a pair of spaced apart axle supporting brackets, shown generally at 5, are secured with bolts 6 or other fasteners. These axle support brackets 5 can be welded directly to the stretcher structure if desired.

Figure 2:
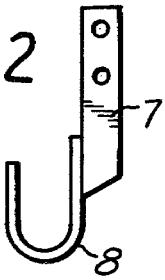
FIG. 2 is an enlarged side elevational view of the axle support bracket for the sheet dispensing roll of FIG. 1.

In the enlarged view of the axle supports shown in FIG. 2, a suspending member 7 is shown attached to a generally U-shaped saddle member 8 giving the axle support a somewhat J-shape. Such mounting brackets are extremely simple and easy to manufacture and the supporting arm of the J-shaped member is of a sufficient length to permit ready insertion and removal of an axle without loosening or removing the J-shaped member. They can be routinely installed on the stretchers and manufactured without substantially increasing their cost. They do not require a supporting wall structure on the stretcher in axial alignment with the roll's axle on which to secure the U-shaped saddle members. Thus, such stretchers would always have the option of using a disposable sheeting system. The hospital would simply have to buy the rolls of disposable sheeting material.

Figure 3:
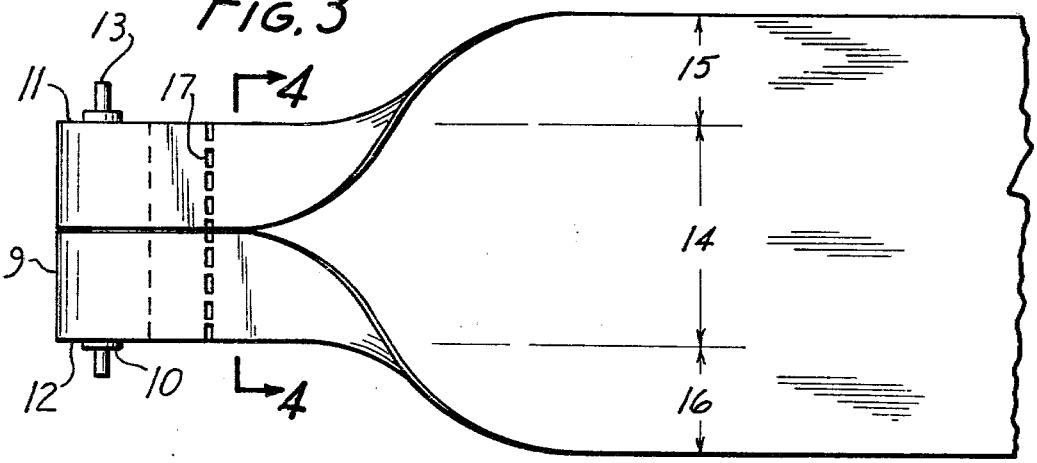
FIG. 3 is a top plan view of the disposable sheet showing its configuration in folded and unfolded conditions.

As shown in FIG. 3, the roll of sheeting material 9 has a tubular paper core 10 that might or might not protrude from ends 11 and 12 of the rolled sheet material. An axle 13, such as a wooden dowel pin, protrudes from each end of the tubular core 10. It is the ends of this dowel pin 13 that fits in the spaced apart saddles 8 of the hanging brackets.

The width of the roll 9 of the sheeting material in continuous roll form is approximately equal to the width of the mattress pad 4. While the sheet is on the coiled roll, side portions 15 and 16 are superimposed over a central portion 14. As the roll is uncoiled, the side portions 15 and 16 lie on top of the central portion 14. Each side portion covers more than $\frac{1}{4}$ (and preferably approximately $\frac{1}{2}$) of the central portion 14. When the disposable sheet is lying on top of the mattress, the sheet is severed by manual tension along the superimposed perforation 17 in the side and central portions of the sheet and the continuous roll sheet material is substantially uniform and unweakened between these spaced frangible sections. Preferably, these perforations are in the form of elongated slots with a central plug of material in each slot that is or can be removed and the frangible sections are held together by the sheet material itself in an unseamed structure. It has been found that this greatly enhances the visibility of the position of the perforated section. Therefore, an operator can see such perforations so he can slightly twist the sheeting material to tear it against one end of the stretcher and rip off an individual sheet, even though he may be standing at an opposite end of the stretcher to where he has pulled the sheeting material.

Figure 4:
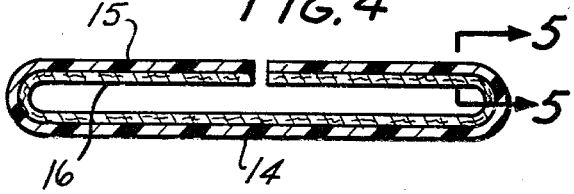
FIG. 4 is a sectional view taken along line 4—4 of FIG. 3.
Figure 5:
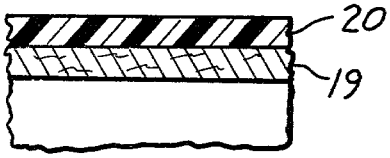
FIG. 5 is an enlarged sectional view taken along line 5—5 of FIG. 4.

In FIG. 4, the overlying relationship of the side portions and central portion are clearly illustrated. Preferably this sheeting material is made of a laminated top layer 19 of nonwoven cellulosic material, such as of rayon fibers oriented in a longitudinal direction. To this top layer is laminated a bottom layer 20 of liquid impervious thermoplastic, such as polyethylene. FIG. 5 shows the laminated structure of one side panel. As the side panel is unfolded, the absorbent layer 19 will be on top of layer 20 until it is tucked under the mattress pad. The central section 14 which lies under the patient has absorbent layer 19 as its top layer. It has been found that tearability improves when the transverse perforations 17 are across the fiber directions rather than parallel to them. Because of the longitudinal orientation of the fiberous nonwoven material, the preferred sheeting material can stretch slightly in its transverse direction, but stretches very little in its longitudinal direction, thereby making a more positive unrolling action. If desired, a very thin central foam layer (not shown) could be laminated between the nonwoven top layer and the thermoplastic bottom layer to increase the liquid absorption capacity of the sheet.

A second embodiment of the sheeting system shown in FIGS. 6–12 has a supporting stretcher top structure 30 on which is supported a mattress 31. Sheet material 32 is dispensed from a roll encased in a housing, shown generally as 33.

Housing 33 includes an upper shell portion 34 that is rigidly mounted to the stretcher top 30 by mounting brackets 35 and 36. Shell 34 does not rotate on brackets 35 and 36, but is secured to such brackets by double-sided adhesive foam tape sections 37 and 38. Pivot pins 39 and 40 extend through both the mounting brackets and end walls of shell 34 to pivotally mount a movable closure or lid 41. The pivot pins can be machine screws or bolts.

Figure 6:
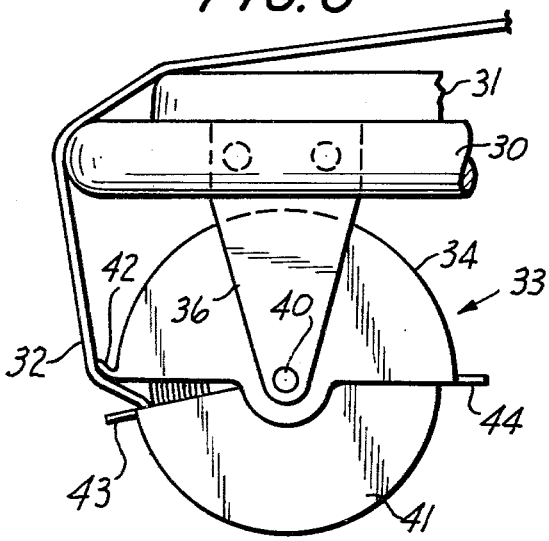
FIG. 6 is an enlarged side elevational view of a second embodiment of the disposable sheet system showing a housing for a sheet roll.
Figure 7:
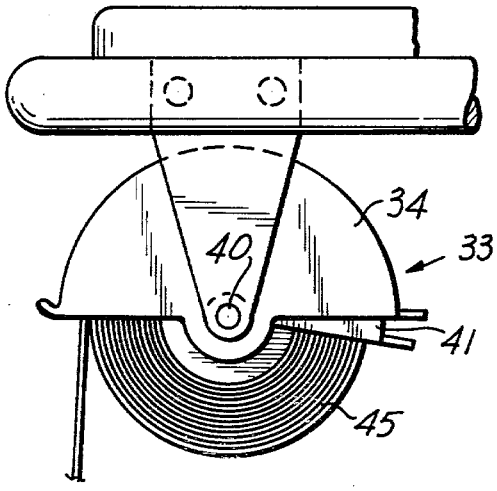
FIG. 7 is a view similar to FIG. 6, but showing the housing in open position for loading.

In FIG. 6, the lid 41 is shown in closed dispensing condition. Preferably, the shell and lid have flanges 42 and 43 respectively to guide the sheet material as it is dispensed from a slot between shell 34 and lid 41. These flanges also help to strengthen and rigidify the shell and lid. The shell 34 can also have a flange 44, but preferably lid 41 has only the single flange 43. Thus, lid 41 can fit very close to shell 34 as it pivotally rotates within shell 34 for opening the shell, as shown in FIG. 7 for loading and unloading the rolls of sheeting, such as shown at 45.

Figure 9:
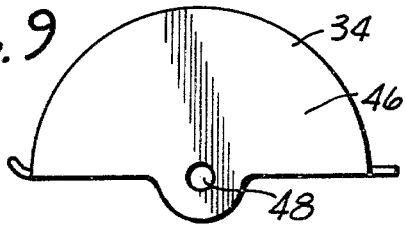
FIG. 9 is a right end view of an upper portion only of the housing taken along line 9—9 of FIG. 8.
Figure 10:
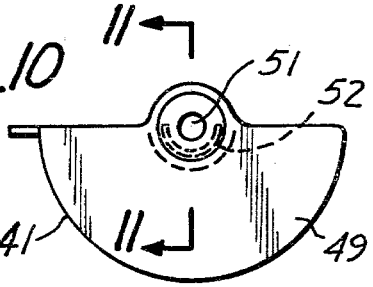
FIG. 10 is a right end view of a lower portion only of the housing taken along line 9—9 of FIG. 8.

The actual shape of the shell and lid can best be seen in FIGS. 9 and 10. Here the shell 34 includes a central section that is generally semicircular and is joined to a pair of end walls 46 and 47. An aperture 48 provides the mounting structure for the pivot pins.

Figure 8:
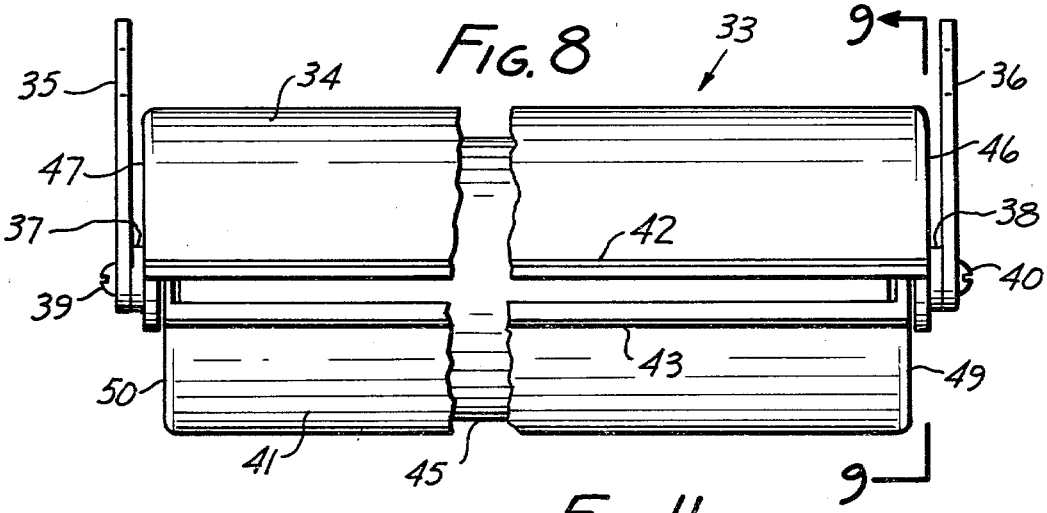
FIG. 8 is a front elevational view of the sheet housing structure of FIG. 6.

Fitting inside shell 34 is lid 41 that likewise has a central portion which is generally semicircular and joins end walls 49 and 50. As shown in FIG. 8, the end walls 49 and 50 of the lid fit inside the end walls 46 and 47 of the shell. Thus, aperture 48 of the shell and aperture 51 of the lid can be aligned for receiving a pivot pin.

Figure 11:
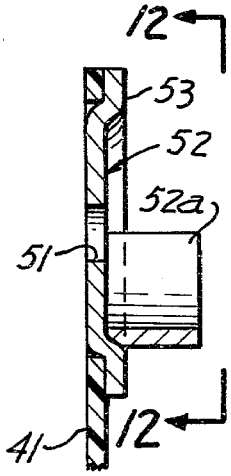
FIG. 11 is an enlarged sectional view taken along line 11—11 of FIG. 10.
Figure 12:
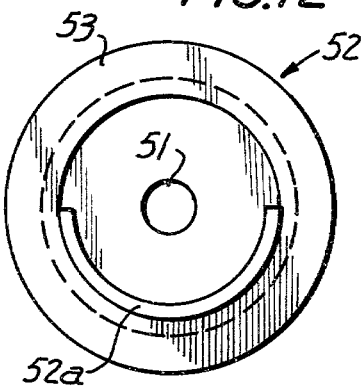
FIG. 12 is a right end view of FIG. 11 taken along line 12—12.

The shell 34 and lid 41 can be economically formed of acrylonitrile-butadiene-styrene (ABS) thermoplastic material. To strengthen the thermoplastic lid and also provide an actual support, a structure, shown in FIG. 11, is used. Here a metal disk 52 has an offset flange 53 that is adhesively bonded or otherwise secured to the thermoplastic material of lid 41. A U-shaped metal saddle **52*a* is welded or otherwise attached at a shoulder area of disk 52. This configuration is shown in FIG. 12**.

Since U-shaped saddle **52*a* is attached to movable lid 41 and not stationary shell 34, the saddle can rotate and be generally inverted in the FIG. 7 view for easy insertion and removal of sheeting rolls. As lid 41 assumes the position in FIG. 6 for dispensing, the U-shaped saddle is again upright providing pivoting structure support for axles of the sheeting rolls. These axles can be wooden dowel pins, as described in the FIG. 1** embodiment of this invention.

Once the roll of sheeting has been installed in the housing described in the second embodiment, the lid automatically pivots to close the shell's opening to a narrow dispensing slot. This is because the lid has a structure, shown in FIG. 10, in which the center of gravity is below its pivot point 51. Therefore, no complicated springs or other mechanisms are needed to close the lid and maintain a narrow slot for dispensing the sheeting material. Such narrow slot helps to reduce the chance of contaminating the sheet material prior to use.

Although specific examples have been used to describe the invention, it is understood by those skilled in the art that certain modifications could be made to the examples without departing from the spirit and scope of the invention.

We claim:

1. A patient supporting structure which has a mattress pad and an attached roll of disposable sheet material, wherein the improvement comprises: said roll being in a continuous form that is free of connecting seams between sheet sections, said continuous form roll having a series of transverse weakened manually frangible sections that are held together by the sheet material itself in an unseamed structure, and said frangible sections are longitudinally separated by a distance substantially greater than the longitudinal length of the mattress, and the material is substantially uniform and unweakened between the longitudinally spaced frangible sections; wherein said sheet material has an upper layer of absorbent nonwoven cellulosic material having a fiber orientation in the longitudinal direction of the sheet material whereby each transverse frangible section cuts laterally across the longitudinally oriented fibers; and a bottom layer of water impervious thermoplastic film laminated thereto.

2. A patient support structure having a mattress pad in a roll of disposable sheet material attached thereto, wherein the improvement comprises: said roll of disposable sheet material having a center portion and opposite side portions folded inwardly toward such center portion; and an unrolling system on the patient support structure that delivers the disposable sheet material to a top surface of a mattress with the folded side portions superimposed on top of the center longitudinal portion of the sheet material; and said roll of sheet material being in a continuous form that is free of connecting seams between sheet sections, said continuous form roll having a series of transverse weakened manually frangible sections that are held together by the sheet material itself in an unseamed structure, and said frangible sections are longitudinally separated by a distance substantially greater than the longitudinal length of the mattress, and the material is substantially uniform and unweakened between the longitudinally spaced frangible sections; wherein said sheet material has an upper layer of absorbent nonwoven cellulosic material having a fiber orientation in the longitudinal direction of the sheet material whereby each transverse frangible section cuts laterally across the longitudinally oriented fibers; and a bottom layer of water impervious thermoplastic film laminated thereto.

3. The patient support structure as set forth in claim 2, wherein the folded side portions have a combined width that is greater than one half of the width of the center postion.

4. The patient support structure of claim 3, wherein the folded edge portions have a combined width that is approximately equal to the width of the center portion, whereby the rolled sheeting material forms a coiled web having a generally constant two ply thickness across substantially its entire web width.

5. A roll of disposable sheeting material for attaching to a patient support structure having a mattress pad, wherein the improvement comprises: said roll of sheeting material being in a continuous form that is free of connecting seams between sheet sections, said continuous form roll having a series of transverse weakened manually frangible sections that are held together by the sheet material itself in an unseamed structure, and said frangible sections are longitudinally spaced apart by a distance substantially greater than the length of such mattress, and the material is substantially uniform and unweakened between the longitudinally spaced frangible sections; and said disposable sheet material has a center body portion and side portions folded inwardly upon the center portion so the transverse weakened manually frangible sections of the side portions and center portion are aligned, whereby the sheet material can be conveniently manually separated while in such folded condition; wherein said sheet material has an upper layer of absorbent nonwoven cellulosic material having a fiber orientation in the longitudinal direction of the sheet material whereby each transverse frangible section cuts laterally across the longitudinally oriented fibers; and a bottom layer of water impervious thermoplastic film laminated thereto.

6. The roll of disposable sheeting material as set forth in claim 5, wherein the side portions have a combined width that is approximately equal to the width of the center body portion, thereby giving substantially the entire width of the folded sheet a constant thickness equivalent to twice the thickness of the unfolded sheet material.

* * * * *